United States Patent [19]

Harvey

[11] Patent Number: 4,737,686

[45] Date of Patent: Apr. 12, 1988

[54] GAS PLASMA DOT MATRIX DISPLAY PANEL

[75] Inventor: Edgar L. Harvey, Jamesburg, N.J.

[73] Assignee: Telegenix, Inc., Cherry Hill, N.J.

[21] Appl. No.: 890,504

[22] Filed: Jul. 30, 1986

[51] Int. Cl.[4] ..... H01J 17/04

[52] U.S. Cl. ..... 313/584; 315/169.4

[58] Field of Search ..... 313/582, 583, 584, 586, 313/587; 315/169.4

[56] References Cited

U.S. PATENT DOCUMENTS 3,699,376 10/1972 Caras ..... 313/585

*Primary Examiner*—David K. Moore

*Assistant Examiner*—Sandra L. O'Shea

*Attorney, Agent, or Firm*—Robert A. Green

[57] ABSTRACT

A dot matrix display panel having cathodes of a shape to provide an area of glow with each cathode having a cutout portion to reduce the power required to cause the cathode to glow, the glow filling the space formed by the cutout portion. The panel includes line-like anodes which overlie the cutout portions of the cathodes.

16 Claims, 3 Drawing Sheets

GAS PLASMA DOT MATRIX DISPLAY PANEL

BACKGROUND OF THE INVENTION

Dot matrix gas plasma display panels are well known in the art and in the electronics industry. One panel of this type is a DC panel which uses strip cathodes in contact with the gas filling of the panel to define dot-like glow areas. There is also an AC display panel which uses crossed electrodes outside of the gas in the panel to define dot-like glow areas. Both types of panels provide relatively small areas or dots of glow and the industry has not been able to use known technology to provide large dots of light because of difficulties of construction and the expense of operation, especially in the DC form of the panel.

DESCRIPTION OF THE INVENTION

Figure 1:
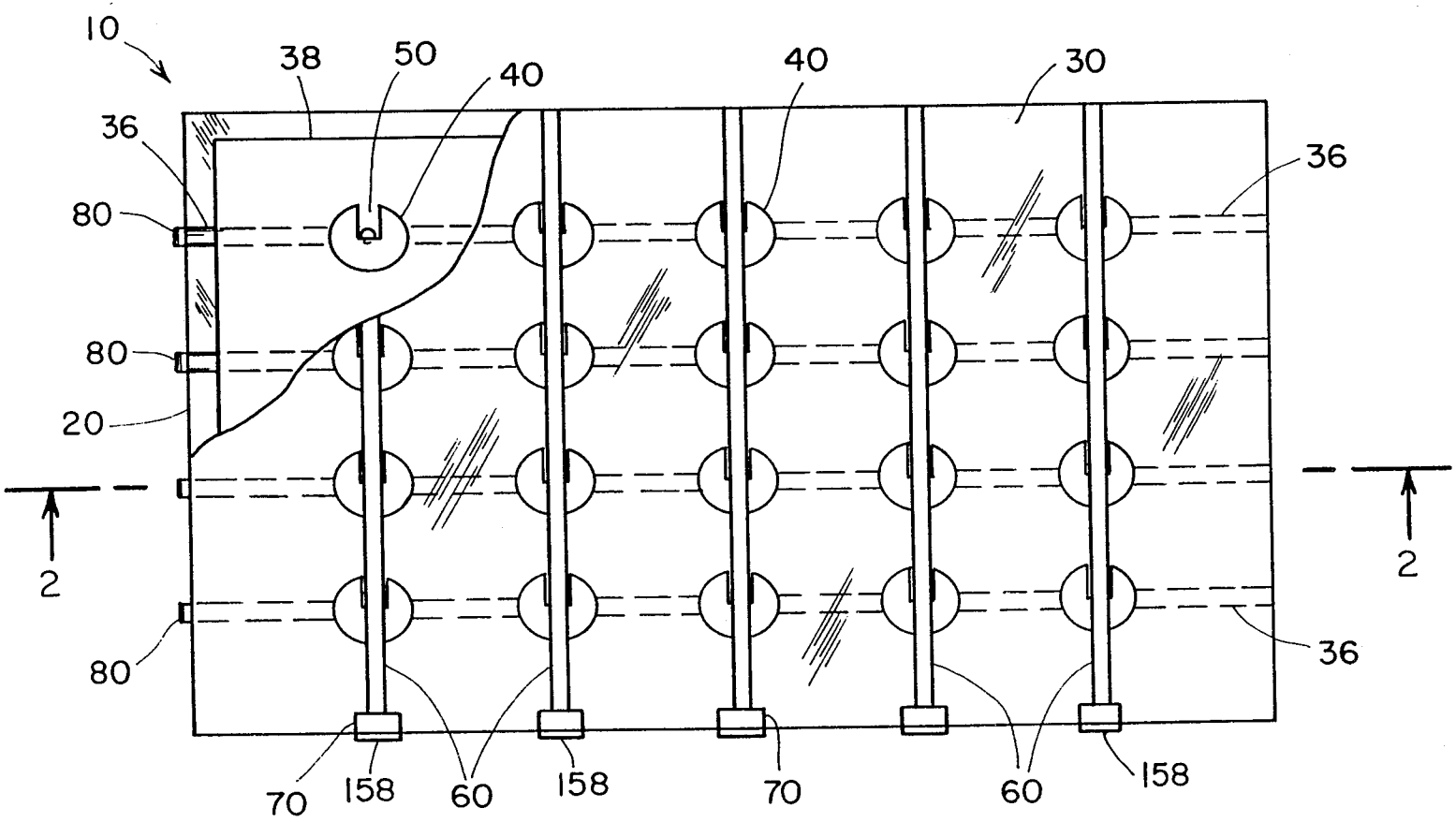
FIG. 1 is a plan view of a display panel embodying the invention.
Figure 2:
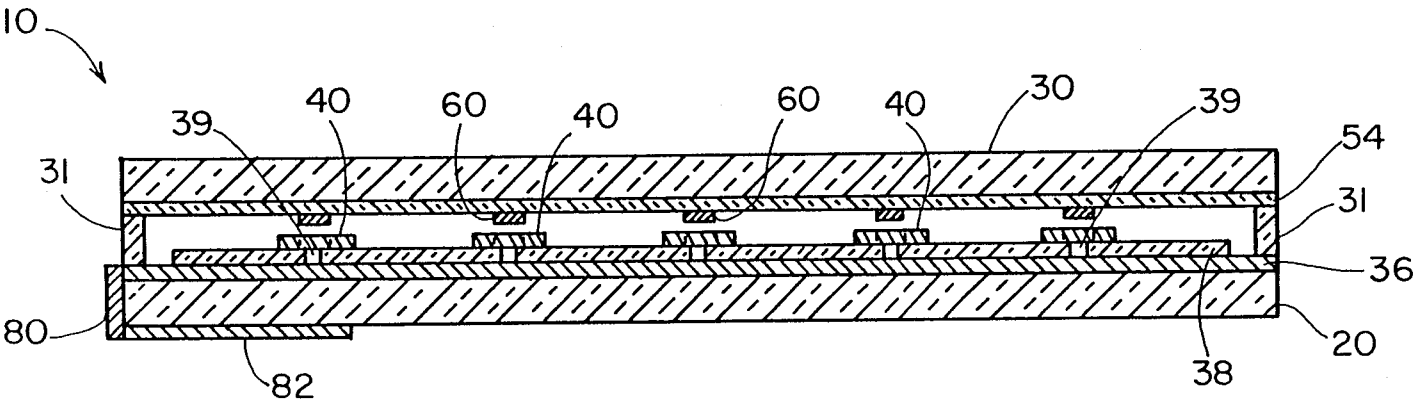
FIG. 2 is a sectional view along the lines 2—2 in FIG. 1.

A dot matrix gas plasma display panel 10 embodying the invention includes an envelope made up of a glass base plate 20 and a transparent glass face plate 30 hermetically sealed together along their aligned peripheries by a seal 31. The panel envelope is filled with an ionizable gas capable of sustaining cathode glow and a small quantity of mercury vapor to minimize cathode sputtering. The base plate 20 of panel 10 includes an upper edge 23, a lower edge 24, a right edge 25 and a left edge 26.

For purposes of definition in the description of the invention, the upper edge 23 and lower edge 24 of the base plate are considered to be horizontal and the right edge 25 and left edge 26 are considered to be vertical.

Figure 4:
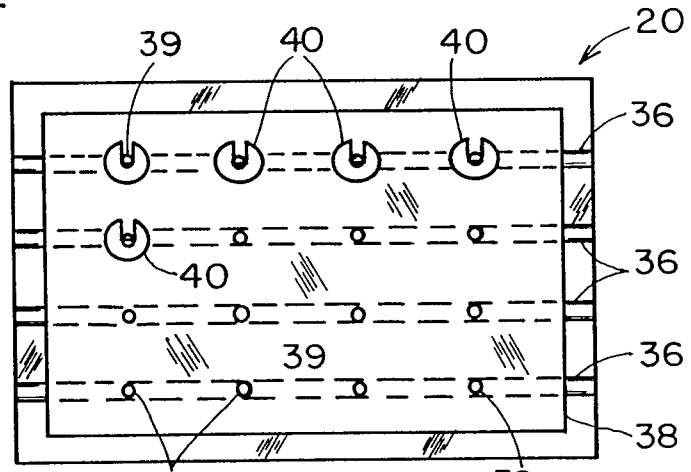
FIG. 4 is a plan view of the base plate of FIG. 3 at a later stage in the preparation of the panel.
Figure 3:
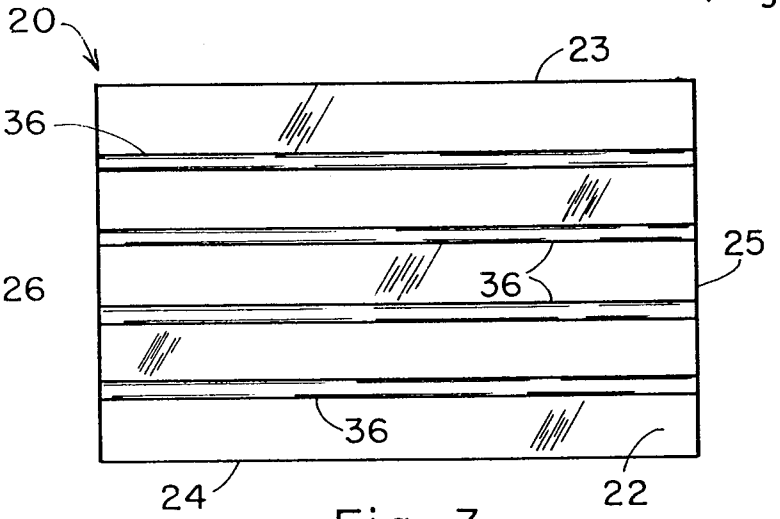
FIG. 3 is a plan view of the base plate of the panel of FIG. 1 at an early stage in the manufacture of the panel.
Figure 6:
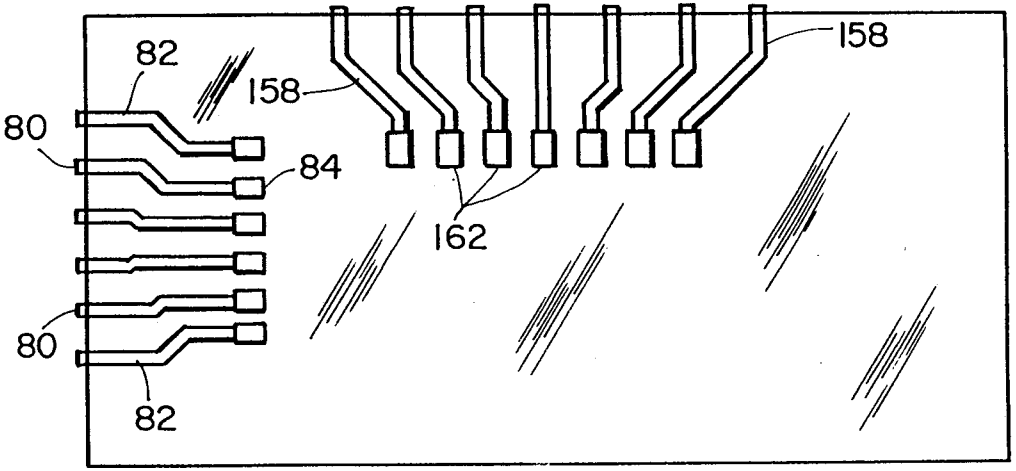
FIG. 6 is a plan view of the bottom surface of the base plate of a completed panel showing one arrangement for making electrical connection to the cathodes and anodes of the panel.

An array of thin, narrow horizontal conductors 36 is screened on the top surface 22 of the base plate with any suitable conductive material. The conductors 36 extend from the left edge 26 to the right edge 25 of the base plate (FIG. 3). The top surface of the base plate carrying the conductors 36 is coated with a thin layer of insulating material 38, preferably black in color for viewing contrast, and formed with openings or vias 39 at spaced locations along the conductors to expose portions of the conductors (FIGS. 1 and 4). The layer 38 does not extend to the edges of the base plate where the hermetic seal is formed, although it might do so if desired.

The panel 10 includes an array of cathode electrodes 40 disposed in rows and columns on the layer 38 on the top surface of the base plate. The cathode electrodes, like the conductors 36, are preferably formed by a screening process with any suitable conductive material or ink including nickel or some other suitable metal. The cathodes are screened on so that each overlies one opening 39 in the insulating layer 38 and makes contact with its conductor 36 therethrough.

According to the invention, the cathode electrodes 40 are generally circular in form and each has a cutout, generally U-shaped portion 50 (FIGS. 1 and 4) which extends along the vertical diameter of the circle of the cathode from the upper edge thereof to about the center of the circle. Thus, the cutouts can be considered to lie parallel to the left and right, vertical edges of the base plate. All cutouts 50 lie on the vertical diameters of all of the cathodes in a column and all are aligned in each column. Each cutout portion 50 reduces the operative area of its cathode 40, for a purpose to be described. It will be clear to those skilled in the art that the principles of the invention do not require that the cutouts be oriented vertically.

Figure 5:
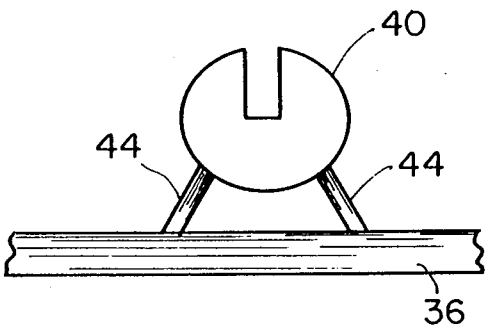
FIG. 5 is a plan view of a modified cathode and its conductor run arrangement.
Figure 7:
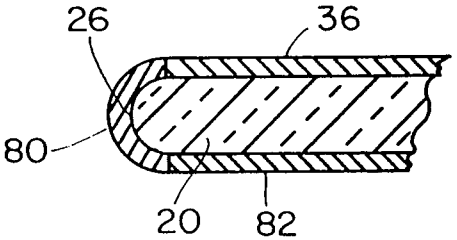
FIG. 7 is a sectional view of a modification of a portion of the base plate of the panel of the invention.

It is noted that the cathodes 36 and their runs or conductors 36 may be formed in a single screening operation with the runs being covered with the insulating layer 38 but with the vias not being required. With this arrangement, the cathode circles might be connected by one or more tabs 44 to the runs 36 (FIG. 5).

The inner surface 32 of the face plate 30 is coated with a transparent coating 54 of a material such as silicon dioxide to prevent any possible reaction of mercury in the gas filling of the panel with sodium in the glass of the face plate. If such a reaction occurred, the face plate would become cloudy in places and this would interfere with the transmission of light through the face plate and with the viewability of the panel display.

The anodes 60 for the panel 10 are formed on the coated inner surface 32 of the face plate and one anode is provided for each column of cathode electrodes 40. According to the invention, each anode 60 comprises a thin, vertical line-like conductor which may be about the width of the cutout portions of the cathodes or a little narrower. The anodes are preferably of a metal such as nickel to obtain good conductivity and strength but since it is narrow, about 20 mils typically in width, the anodes do not obstruct the cathode glow. Typically, a 20 mil wide anode is used with a cathode having a diameter of about 0.260", with the cutout portion having a width of about 20 mils, and with the cathodes having a center-to-center spacing of about 0.300".

Each anode 60 extends to the lower edge of the face plate where it terminates in a contact pad 70. The anodes and their extensions to the lower edge 24 of the face plate may be formed by a screening process using any suitable conductive paste or ink.

In one method of making electrical connections to the cathode conductor runs 36, conductive strips 80 are provided extending from an end of each run 36 along the left (or right) edge of the base plate to a run 82 of any suitable length on the bottom surface of the base plate as seen in FIG. 5. Thus, a plurality of parallel runs 82 are formed on the bottom surface of the base plate, one for each run 36 and these terminate in pads 84 to which a cable (not shown) can be secured. Circuit connections can be made to this cable as required to couple voltages and signals to the cathodes of the panel.

The anodes 60 are similarly coupled from their end pads 70 to conductive strips 158 which are painted or screened from the pads 70 along the panel seal to the bottom surface of the base plate where they extend to a series of closely spaced aligned pads 162 to which a connector cable (not shown) can be secured as is well known in the art.

The required electrical power supply and signals are connected through the cables and pads 154 and 162 to the anodes and cathodes within the panel to provide the desired display operation as is well known in the art.

It is noted that the formation of the conductive runs or stripes 82 by painting, or the like process, along the edge of the base plate 20 is facilitated if the edges of the base plate are slightly curved or rounded. It is also desirable if the seal 31 presents a favorable accessible surface to receive the anode stripes 158.

In the manufacture of the panel 10, the base plate and face plate assemblies are sealed together hermetically by means of seal 31 formed with a suitable glass frit cement such as Pyroceram. Subsequent processing steps include bakeouts and filling of the panel envelope with an ionizable gas such as neon, argon or the like singly or in suitable combinations. In addition, a small quantity of mercury vapor is added to the gas filling to prevent cathode sputtering. If desired a tubulation may be secured to the base plate in alignment with a hole in the base plate to perform the gas filling and the introduction of mercury. Such processing steps are well known in the art and need not be described in detail.

Figure 9:
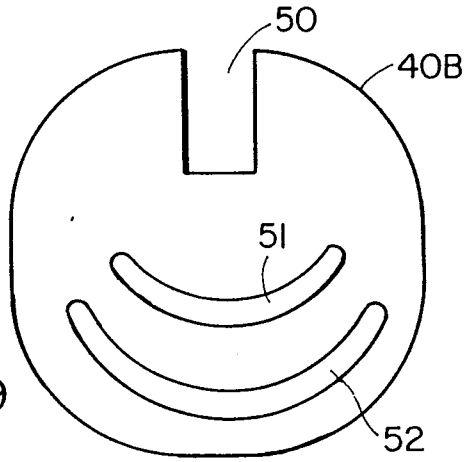
FIG. 9 is a plan view of still another modified cathode.
Figure 8:
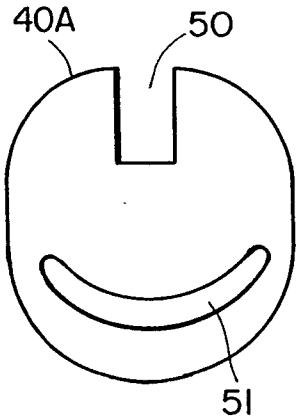
FIG. 8 is a plan view of a modified cathode.

In a modification of the cathodes of the invention, as illustrated in FIG. 8, if the cathodes are enlarged sufficiently, for example as cathode 40A, additional power savings can be made but with full glow achieved by providing an auxiliary slot 51 in the main body of the cathode. With a circular cathode, the slot might conveniently be crescent-shaped and oriented transverse to the vertical axis of the cathode and extending between the side edges of the cathode and may extend to close to the side edges. If the cathode is enlarged still more, as illustrated in FIG. 9, then slot 51 can be provided and, in addition, a second crescent-shaped slot 52 may also be provided parallel, to slot 51, oriented transverse to the vertical axis of the cathode and extending between the side edges of the cathode.

Slots 51 and 52 may be other than crescent-shaped as those skilled in the art will understand.

Among the many advantages of panel 10 are included the advantage that the panel can produce a relatively large dot of glow with its cathodes while the power required is less than would be required with full cathodes of similar size. In addition, the thin wire-like anodes provide favorable anode function while not interfering with viewing of the panel. The thin anodes also provide good anode function with no cross-talk to adjacent cathodes. In addition, no cell sheet is required in the panel to achieve localized dots of glow but dot isolation is achieved with the aid of the thin anodes.

What is claimed is:

1. A dot matrix display panel comprising an envelope made up of a base plate and a transparent glass face plate hermetically sealed together along their aligned peripheries, said envelope being filled with an ionizable gas of the type which can sustain cathode glow, an array of dot-like cathode electrodes disposed in rows and columns on said base plate, said cathode electrodes each having a shape to produce a defined area of glow when energized with electrical potentials, each cathode comprising a body of conductive material defining an area, each cathode having a cutout portion which reduces the operational area of the cathode and the power required to produce glow over the entire surface of the cathode, the cutout portion being such that the glow produced by the cathode fills the cutout portion so that glow appears to a viewer to cover the entire area of the cathode, and an anode electrode overlying the cutout portion of each cathode and providing anode operation for the cathode without obstructing the viewability of the cathode.

2. The panel defined in claim 1 wherein said anode electrodes are about as wide as said cutout portions and each anode overlies the cutout portions of the cathodes which it overlies.

3. The panel defined in claim 1 and including a plurality of parallel, horizontal conductive runs on said base plate, a layer of insulating material on said base plate, covering said conductive runs but having small openings exposing portions of said runs at selected locations, said cathode electrodes being formed on said layer of insulating material, each making contact with one of said conductive runs.

4. A dot matrix display panel comprising an envelope made up of a base plate and a transparent glass face plate hermetically sealed together along their aligned peripheries, said envelope being filled with an ionizable gas of the type which can sustain cathode glow, an array of cathode electrodes disposed in rows and columns on said base plate, said cathode electrodes each being generally circular in form but each having a cutout portion which reduces the operational area of the cathode and the power required to produce glow over the entire surface of the cathode, the glow produced by each cathode covering and filling the cutout portion and producing a full circular area of glow, and an anode electrode overlying each column of cathode electrodes and overlying the aligned cutout portions of the cathodes.

5. A cathode glow gas filled display panel comprising a gas filled envelope made up of a glass base plate and a transparent glass face plate hermetically sealed together, a plurality of cathode electrodes disposed in rows and columns on said base plate, each cathode being generally circular in shape and having a generally U-shaped cutout portion on its vertical diameter, and an array of anode electrodes on the inner surface of said face plate, the anodes comprising thin, parallel, linear conductors, each overlying a column of cathode electrodes, the cutout portions of said cathodes reducing the power required to provide cathode glow over the entire surface of a cathode with the glow appearing to cover the cutout portion thereof.

6. The panel defined in claim 1 wherein each cathode cutout portion extends from the upper edge of each cathode and along the vertical diameter thereof.

7. The panel defined in claim 1 wherein each cathode is generally circular in shape and the cutout portion thereof extends along the vertical diameter thereof to near the center of the circle formed by the cathode.

8. The panel defined in claim 1 and including a transparent coating of silicon dioxide on the inner surface of said face plate.

9. The panel defined in claim 1 wherein said anode electrodes are made of silver.

10. The panel defined in claim 1 wherein each cutout portion of each cathode has a width of about 20 mils and each anode has a width of about 20 mils.

11. The panel defined in claim 10 wherein said anodes overlie the cutout portions of groups of said cathodes.

12. The panel defined in claim 7 and including an auxiliary cutout portion in the body of each cathode.

13. The panel defined in claim 12 wherein said auxiliary cutout portion lies generally transverse to the vertical axis of the cathode and extends between and close to the side edges thereof.

14. The panel defined in claim 13 wherein said auxiliary slot is generally crescent-shaped.

15. The panel defined in claim 14 and including a second auxiliary crescent-shaped cutout portion in the body of said cathode.

16. A cold cathode gas plasma display device comprising an envelope having a transparent portion for viewing characters displayed, said envelope being filled with an ionizable gas of the type which can sustain cathode glow, cathode electrode means disposed in said envelope and having a viewing surface on which cathode glow is formed to provide a visible character display, said cathode electrode means comprising a body of conductive material defining an area to glow and be viewed and having a cutout portion which reduces the operational area of the cathode and the power required to produce glow over the entire surface of the cathode, the cutout portion being such that the glow produced on the cathode surface fills the cutout portion so that glow appears to a viewer to cover the entire area of the surface of the cathode, and anode electrode means in operative relation with said cathode means for providing anode action therefor in the glow-producing process.

* * * * *